US007594831B2

(12) United States Patent
Fan

(10) Patent No.: US 7,594,831 B2
(45) Date of Patent: Sep. 29, 2009

(54) CONDUCTIVE CONTACT

(75) Inventor: Chien-Ming Fan, Guangdong (CN)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/563,032

(22) Filed: Nov. 24, 2006

(65) Prior Publication Data

US 2007/0243742 A1 Oct. 18, 2007

(30) Foreign Application Priority Data

Apr. 14, 2006 (CN) ..... 2006 1 0060310

(51) Int. Cl.
*H01R 13/24* (2006.01)

(52) U.S. Cl. ..... 439/824

(58) Field of Classification Search ..... 439/700, 439/353, 352, 188, 38–39, 824
See application file for complete search history.

(56) References Cited

U.S. PATENT DOCUMENTS 3,057,363 A * 10/1962 Talbot ..... 132/211
3,974,715 A * 8/1976 Habiger ..... 74/570.21
6,250,945 B1 * 6/2001 Murakami et al. ..... 439/353
6,283,766 B1 * 9/2001 Donnelly et al. ..... 439/38
6,343,958 B1 * 2/2002 Wayman ..... 439/700
7,048,574 B2 * 5/2006 Shinohara et al. ..... 439/515
2005/0026499 A1 2/2005 Choi

FOREIGN PATENT DOCUMENTS

CN 1476655 A 2/2004
JP 56-063139 5/1981

* cited by examiner

*Primary Examiner*—Jean F Duverne
(74) *Attorney, Agent, or Firm*—Winston Hsu

(57) ABSTRACT

A conductive contact includes a variable-diameter spring and a post. The variable-diameter spring includes a spiral body having a plurality of rotations, a first end, and a second end configured for securing with the spiral body. The first end and the second end are arranged at two opposite ends of the spiral body. An axis is defined across the first end and the second end, radial intervals are defined between every two adjacent rotations measured substantially perpendicularly to the axis. The post is secured to the first end and configured for detachably and conductively contacting with a conductive pad. Every two adjacent rotations are kept away from each other in response to compression along the axis direction of the spiral body applied on the post.

3 Claims, 7 Drawing Sheets

CONDUCTIVE CONTACT

BACKGROUND OF THE INVENTION

1. Field of the Invention

The present invention relates to conductive contacts and, more particularly, to a conductive contact employed in an electronic apparatus.

2. Description of Related Art

Conductive contacts are generally applied in electronic apparatuses such as mobile phones, portable computers, and personal digital assistants (PDAs) for making electrical connections between two elements thereof.

Common conductive contacts in an electronic apparatus are used as an example for illustration. The electronic apparatus includes a shield defining a plurality of guiding holes therein, a body defining a plurality of cylindrical space therein, and a circuit board fixed to a bottom of the body. Each conductive contact includes a post and a coil spring. The post inserts into the corresponding guiding hole and is bounded by the shield. The coiled spring constructs in a cylindrical shape and is accommodated in the cylindrical space for resiliently supporting one end of the post. The circuit board electrically connects and supports the coil spring. The post perpendicularly moves relative to the shield under both guidance of the hole and resilient support of the coil spring. Another end of the post is in contact with or separated from a specific element such as a grounding pad of a circuit board.

The coiled spring may be pressed under an axial load transmitted via the post so that an axial height of the coiled spring can be shortened to some extent. However, diameters of every two adjacent rotations of the coiled spring are equal because the coiled spring is constructed in a cylindrical shape. Interferences (or obstacles) by adjacent rotations of the coiled spring will be generated when a sufficiently great force is applied thereon. Therefore, a compressible height of the coiled spring in the cylindrical shape is low. It is space-consuming and incompetent for the coiled spring to be utilized in a flat space. In order to fit the flat space, the coiled spring is generally configured shorter. However, resilience performance of the coiled spring in the cylindrical shape can thus be lowered.

Therefore, a conductive contact with a space-saving structure and an electronic apparatus employing the conductive contact are desired.

SUMMARY OF THE INVENTION

A conductive contact includes a variable-diameter spring and a post. The variable-diameter spring includes a spiral body having a plurality of rotations, a first end, and a second end configured for securing with the spiral body. The first end and the second end are arranged at two opposite ends of the spiral body. An axis is defined across the first end and the second end, radial intervals are defined between every two adjacent rotations measured substantially perpendicularly to the axis. The post is secured to the first end and configured for detachably and conductively contacting with a conductive pad. Every two adjacent rotations are kept away from each other in response to compression along the axis direction of the spiral body applied on the post.

Other advantages and novel features will become more apparent from the following detailed description of preferred embodiments when taken in conjunction with the accompanying drawings, in which:

DETAILED DESCRIPTION OF THE INVENTION

Electronic apparatuses can be portable computers, docking stations, foldable disk players, or other electronic apparatuses. In the following embodiments, a combination of a portable computer and a docking station is used as an example for illustration.

Figure 1:
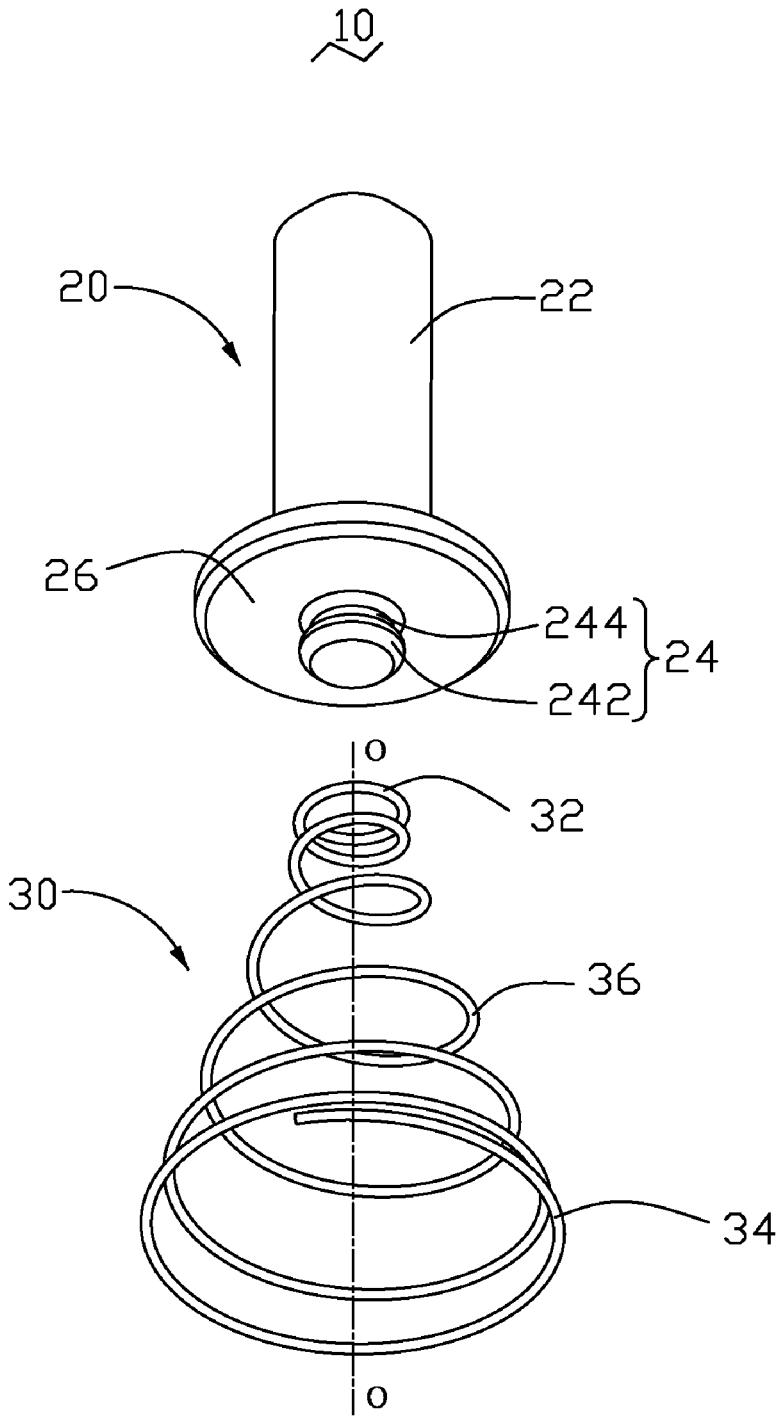
FIG. 1 is an exploded isometric view of a conductive contact in accordance with a first embodiment.

Referring to FIG. 1, a conductive contact 10 in accordance with a first embodiment is illustrated. The conductive contact 10 includes a contacting member 20 and a resilient member 30 connecting to the contacting member 20.

The contacting member 20 includes a contacting portion 22, a fastening portion 24 connecting to the contacting portion 22, and a flange portion 26 circumferentially extending from a joint where the contacting portion 22 connects to the fastening portion 24. The contacting portion 22 may be a conductive post. The fastening portion 24 may also be a conductive post and includes a distal end 242. A groove 244 is defined around a circumference of the fastening portion 24, between the distal end 242 and the flange portion 26.

Figure 2:
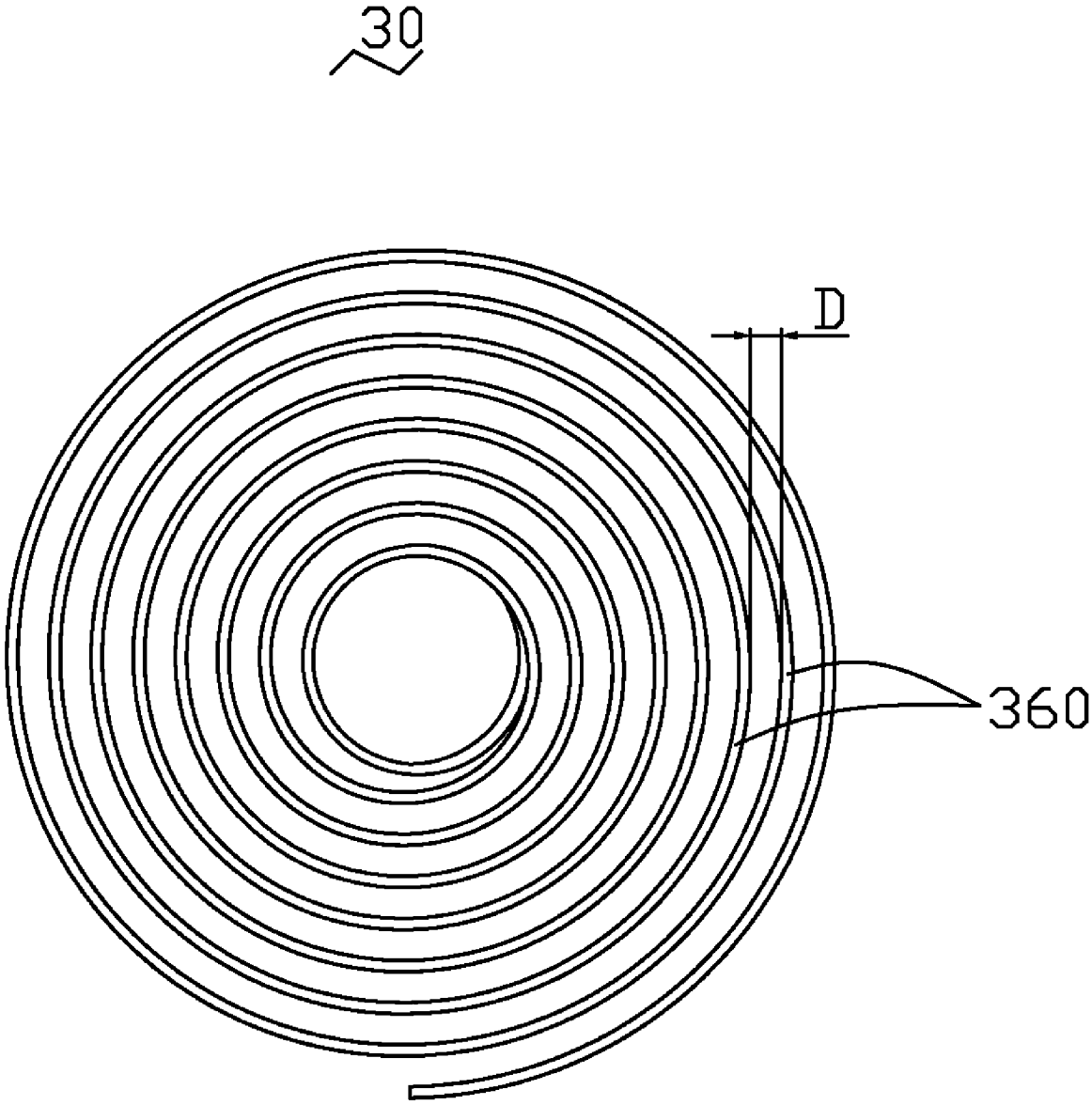
FIG. 2 is an enlarged, top view of a resilient member of the conductive contact of FIG. 1.

The resilient member 30 is a coiled spring constructed in a conical shape and includes a first end 32 configured for connecting to the fastening portion 24, an opposite second end 34 configured for securing the resilient member 30, and a resilient body 36 interconnecting the first end 32 and the fixed end 34. As shown in FIG. 2, the resilient body 36 takes the form of a conical spiral with a plurality of rotations 360. Radii measured perpendicular to an axis O-O of the rotations 360 of the resilient body 36 increases from the first end 32 to the second end 34. A Radial interval D is defined between every two adjacent rotations of the spiral measured perpendicularly to the axis O-O of the resilient member 30.

The contacting member 20 and the resilient member 30 is assembled as follows. The first end 32 of the resilient member 30 is received in the groove 244 and restricted between the distal end 242 and the flange portion 26. The contacting member 20 is thus resiliently supported by the resilient member 30.

When the contacting member 20 is pressed down along the axis O-O, a height of the resilient member 30 is greatly reduced because of the radial intervals D between adjacent rotations 360 of the resilient body 36. If a force applied on the resilient member 30 is sufficiently great, the resilient body 36 even becomes a substantial flat shape from the conical shape. That is, the resilient body 36 is flattened on a planar surface (not shown). If a height of the resilient member 30 at rest equals to that of a cylindrical spring (not shown) at rest, the resilient member 30 may be compressed to a shorter height than the cylindrical spring. Therefore, the compressible height of the resilient member 30 is greater than that of the cylindrical spring when their heights at rest are equal. In other words, the resilient member 30 is more compactable than the cylindrical spring.

Figure 3:
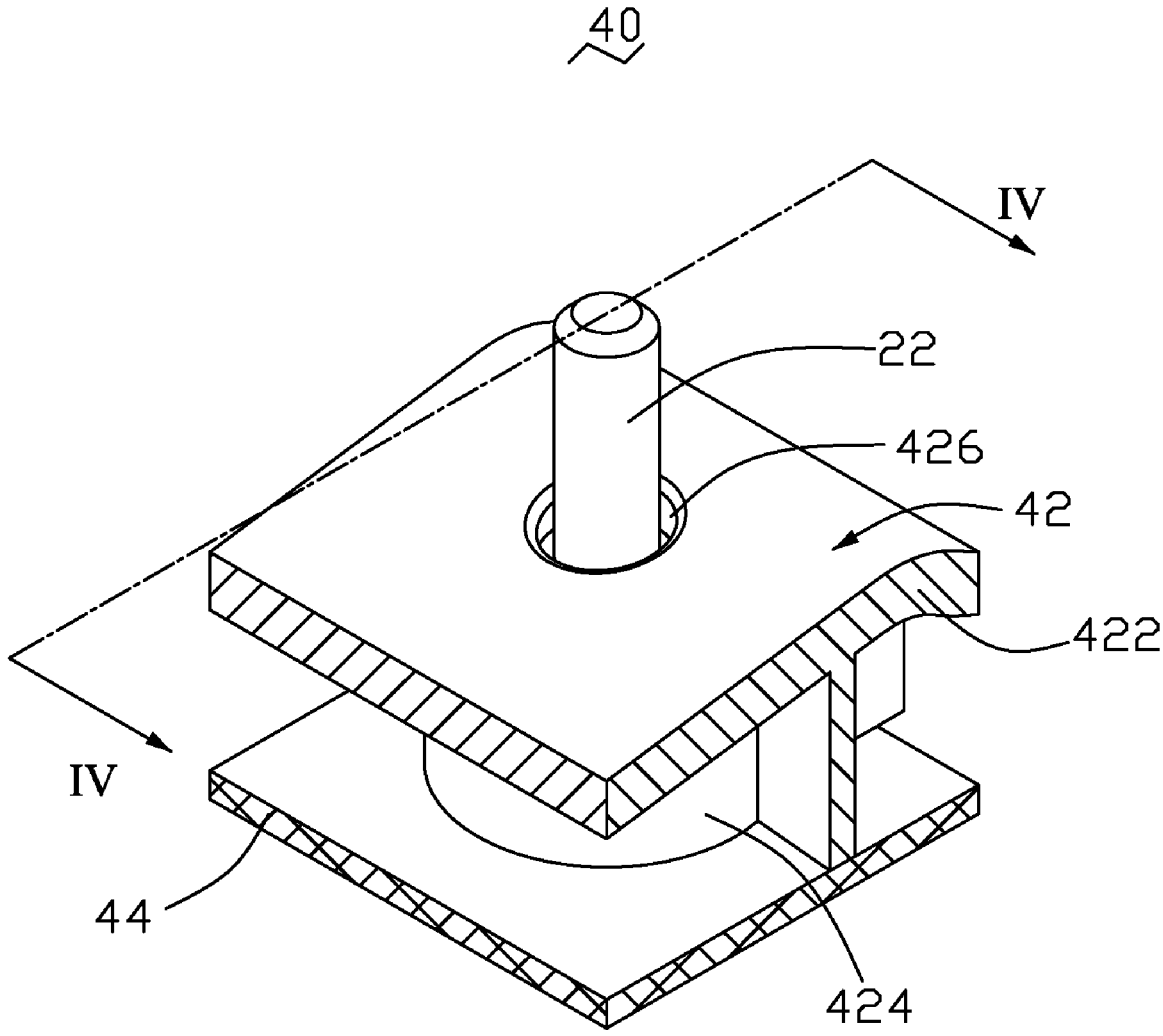
FIG. 3 is an isometric view of an electronic apparatus, with the conductive contact of FIG. 1 being employed therein.
Figure 4:
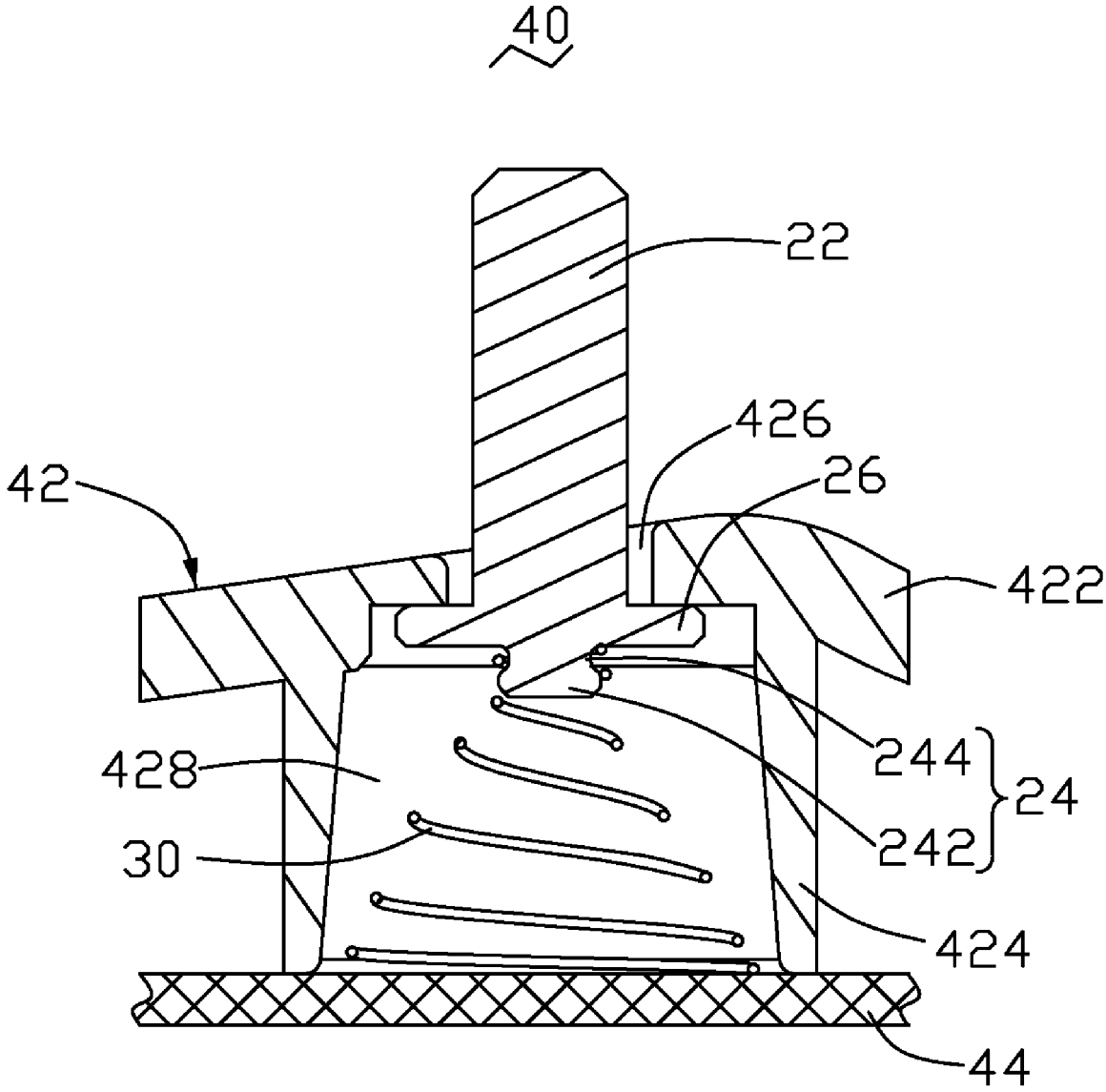
FIG. 4 is a cross-sectional view of the electronic apparatus of FIG. 3 taken along line III-III thereof, with the conductive contact being employed therein.

Referring also to FIGS. 3 and 4, an electronic apparatus 40 employing the conductive contact 10 is illustrated. The electronic apparatus 40 includes a housing 42 and a grounding plate 44. The housing 42 includes an upper plate 422 and at least one wall 424 substantially perpendicularly extending from the upper plate 422. A through hole 426 is defined in the upper plate 422 for the contacting portion 22 of the contacting member 20 to protrude therethrough. The grounding plate 44 attaches to the wall 424 and is opposite to the upper plate 422. A chamber 428 is defined by the upper plate 422, the wall 424, and the grounding plate 44 for accommodating the resilient member 30 therein.

When the conductive contact 10 is assembled into the electronic apparatus 40, the contacting portion 22 of the contacting member 20 protrudes out from the upper plate 422 via the through hole 426, the flange portion 26 and the fastening portion 24 are located under the upper plate 422. The resilient member 30 is received in the chamber 428 with the second end 34 being arranged on the grounding plate 44. The contacting member 20 is thus resiliently supported by the resilient member 30. The contacting portion 22 may be pressed down freely without any interferences (or obstacles) generated by the adjacent rotations 360. The free height of the resilient member 30 can be lessened in a manner so that the chamber 428 can be constructed to be flatter. The electronic apparatus 40 can thus become compact.

Figure 5:
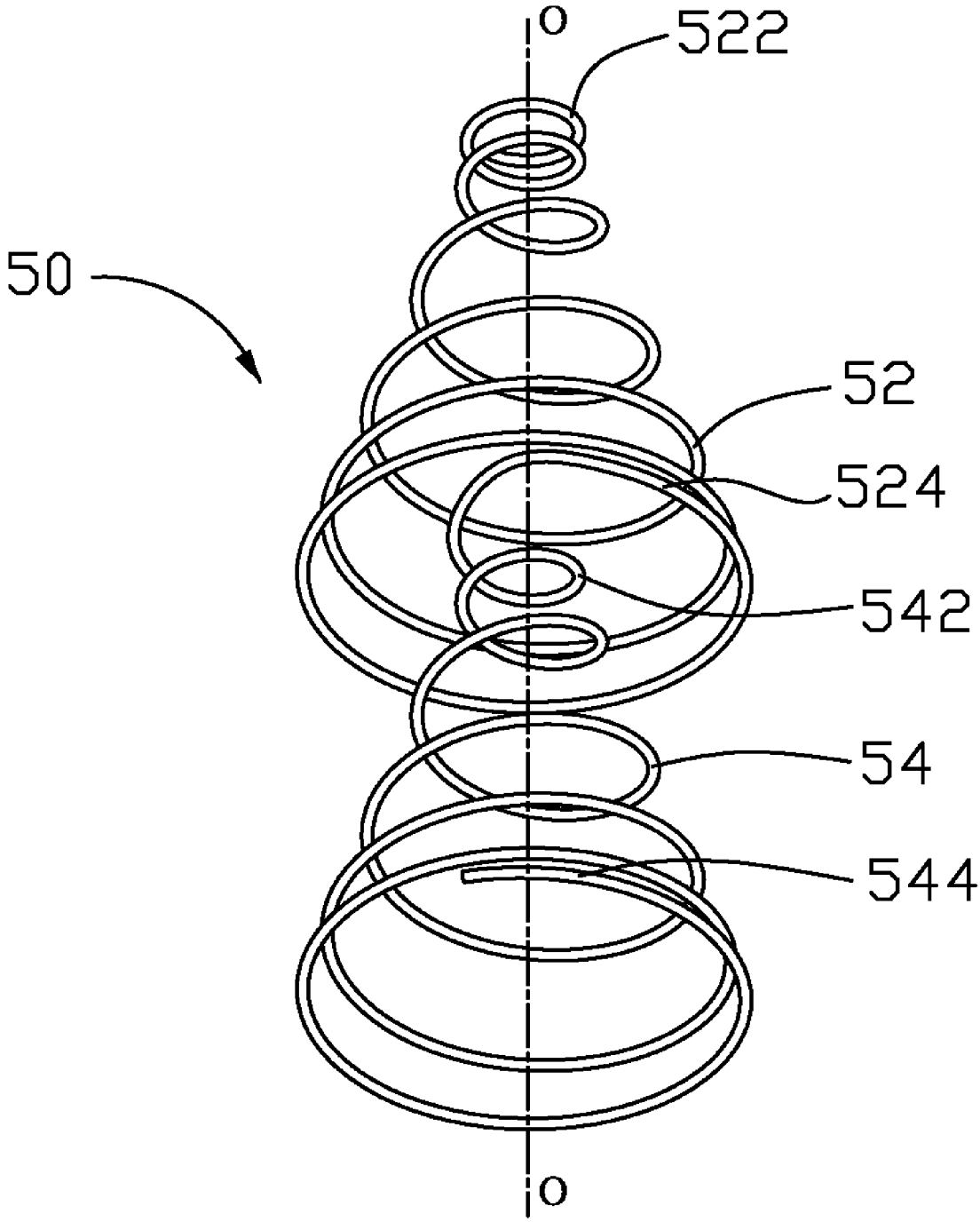
FIG. 5 is an isometric view of a resilient member of a conductive contact in accordance with a second embodiment.

Referring to FIG. 5, a resilient member 50 in accordance with a second embodiment is illustrated. The resilient member 50 includes a first coiled spring 52 and a second coiled spring 54 connecting to the first coiled spring 52. The first coiled spring 52 and the second coiled spring 54 are constructed in conical shapes similar to the resilient member 30. The first coiled spring 52 includes a first end 522 connecting to a contacting member such as the contacting member 20 shown in FIG. 1, an opposite third end 524, and a plurality of rotations (not labeled). The second coiled spring 54 includes a fourth end 542 connecting to the third end 524, an opposite second end 544, and a plurality of rotations. The first end 524 connects to the fourth end 542 so that the first coiled spring 52 and the second coiled spring 54 are aligned to construct a double deck spring module. When the first end of the first coiled spring 52 is pressed, the first coiled spring 52 and the second coiled spring 54 are compressed simultaneously. The first coiled spring 52 substantially surrounds the second coiled spring 54. The height of the resilient member 50 is greatly reduced. The compressible height of the resilient member 50 may be further greater than that of the resilient member 30.

Figure 6:
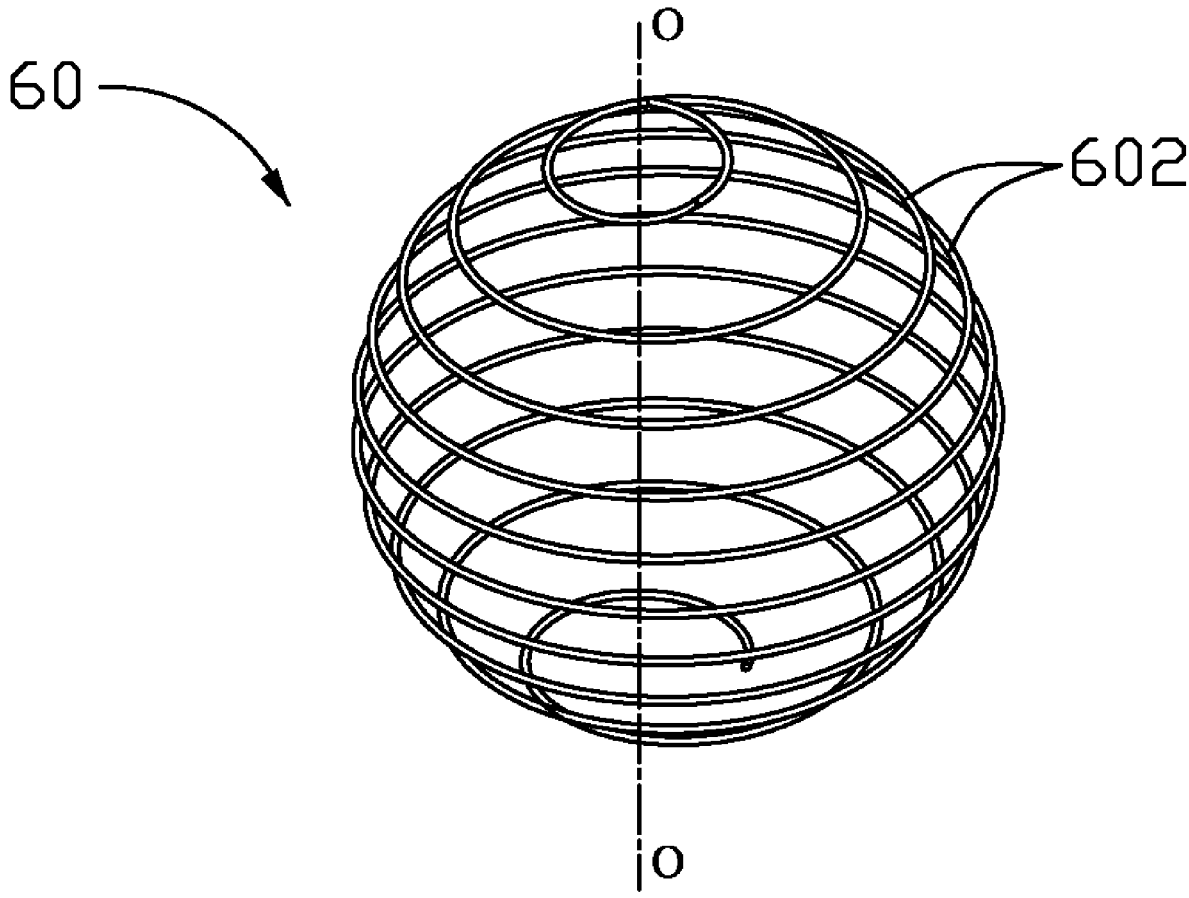
FIG. 6 is an isometric view of a resilient member of a conductive contact in accordance with a third embodiment.

Referring to FIG. 6, a resilient member 60 which may also be constructed in a spherical shape or an oval shape in accordance with a third embodiment is illustrated. Referring to FIG. 5 again, apparently, at least one of the first spring 52 and the second spring 54 may be constructed in a spherical shape instead of the conical shape. Radii measured perpendicular to the axis O-O of the rotations 602 of the resilient member 60 varies. A Radial interval is defined between every two adjacent rotations 602 measured perpendicularly to the axis O-O of the resilient member 60.

Figure 7:
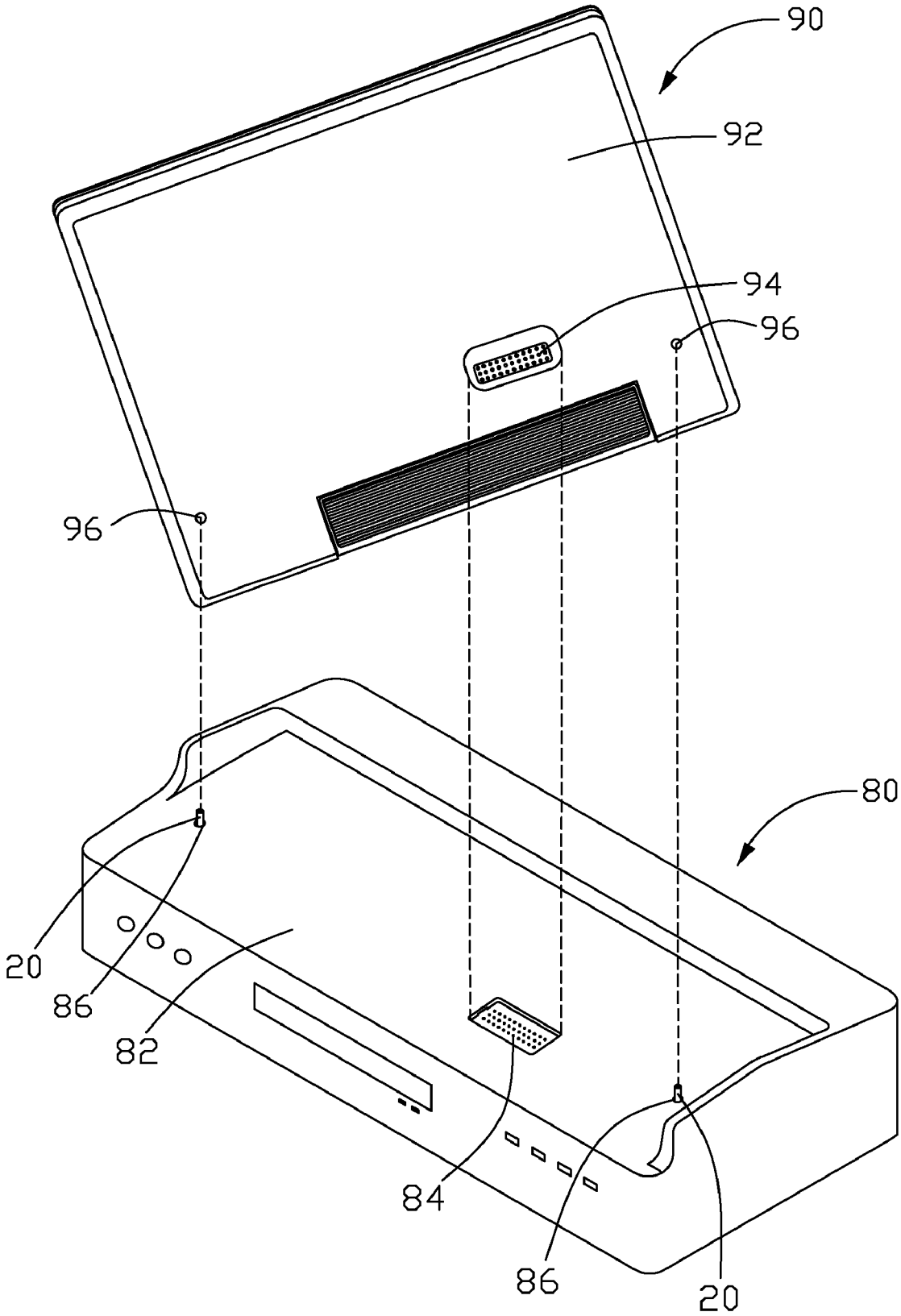
FIG. 7 is an isometric view of a combination of a portable computer and a docking station with the conductive contact selected from FIGS. 3 to 6 therein.

Referring also to FIG. 7, a combination of a docking station 80 and a portable computer 90 is illustrated. The docking station 80 includes an upper plate 82, a connector 84, a grounding sheet (not shown) and a pair of previously described conductive contacts 20. The pair of conductive contacts 20 are secured under the upper plate 82. The docking station 40 defines a pair of thin chambers (not shown) therein for the corresponding conductive contacts 20 being accommodated therein. A pair of through holes 86 are defined in the upper plate 82 for the conductive contacts 20 to partially protrude therethrough. The portable computer 90 includes a bottom plate 92, a complementary connector 94 fixed on the bottom plate 92, and a pair of conductive pads 96 are provided on a circuit board (not shown) and exposed on an outside of the bottom plate 92.

Referring also to FIG. 1, when the portable computer 90 is incorporated onto the docking station 80, the complementary connector 94 aligns with the electronic connector 84 whilst the conductive pads 96 align with the corresponding conductive members 20. Once the conductive pads 96 are in contact with the corresponding contacting portions 22 of the conductive members 20, a pressure is applied to press the conductive members 20 downward. The resilient bodies 36 of the spring members 30 are resiliently deformed. The conductive pads 96, the conductive member 30 and the grounding sheet are electrically connected. The conductive pad 96 is grounded to the grounding sheet so that an electro magnetic interference (EMI) generated between the docking station 80 and the portable computer 90 may be suppressed.

When the portable computer 90 is detached from the docking station 80, the conductive members 20 are restored and resiliently raised in a direction that the portable computer 90 moves away from the docking station 80 because of the resilience of the spring members 30.

The conductive members 20 may be pressed down without any interferences (or obstacles) generated by adjacent rotations 360. The free height of the resilient member 30 can be lessened in a manner so that a space similar to the chamber 428 can be constructed relatively flatter. The docking station 80 can thus become compact.

The embodiments described herein are merely illustrative of the principles of the present invention. Other arrangements and advantages may be devised by those skilled in the art without departing from the spirit and scope of the present invention. Accordingly, the present invention should be deemed not to be limited to the above detailed description, but rather by the spirit and scope of the claims that follow, and their equivalents.

What is claimed is:

1. A conductive contact comprising:

a variable-diameter spring comprising a spiral body having a plurality of rotations, a first end, and a second end, the first end and the second end being arranged at two opposite ends of the spiral body, an axis being defined across the first end and the second end, radial intervals being defined between every two adjacent rotations measured substantially perpendicularly to the axis; and a post secured to the first end, wherein the post comprises a contacting portion for conductively contacting the conductive pad, a fastening portion connecting to the contacting portion for engaging with the first end, and a flange portion circumferentially extending from a joint where the contacting portion connects to the fastening portion, and every two adjacent rotations are kept away from each other in response to compression along the axis direction of the spiral body applied on the post.

2. The conductive contact as claimed in claim 1, wherein a groove is defined around a circumference of the fastening portion for engaging with the first end.

3. The conductive contact as claimed in claim 1, wherein at least one protrusion is configured on a circumference of the fastening portion for clasping the first end.

* * * * *